US006758614B2

(12) United States Patent
Yamada et al.

(10) Patent No.: US 6,758,614 B2
(45) Date of Patent: Jul. 6, 2004

(54) PRINTER UNIT AND PRINTING APPARATUS INCORPORATING THE SAME

(75) Inventors: Rikuo Yamada, Nagano (JP); Hidetoshi Futatsugi, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 10/294,899

(22) Filed: Nov. 15, 2002

(65) Prior Publication Data

US 2003/0118390 A1 Jun. 26, 2003

(30) Foreign Application Priority Data

Nov. 16, 2001 (JP) ..... P2001-352183

(51) Int. Cl.[7] ..... B41J 11/20

(52) U.S. Cl. ..... 400/58; 400/86; 400/59; 400/648; 400/664

(58) Field of Search ..... 400/55, 56, 57, 400/58, 59, 648, 649, 650, 653, 663, 664

(56) References Cited

U.S. PATENT DOCUMENTS 5,201,588 A * 4/1993 Sakai et al. ..... 400/613
5,366,302 A * 11/1994 Masumura et al. .... 400/120.16
5,393,152 A * 2/1995 Hattori et al. ..... 400/691
5,507,582 A * 4/1996 Mistyurik ..... 400/120.16
5,565,905 A * 10/1996 Kajiya et al. ..... 347/222
5,594,487 A * 1/1997 Nuita et al. ..... 347/197
6,155,731 A * 12/2000 Bertalan et al. ..... 400/621
6,217,240 B1 * 4/2001 Lee ..... 400/120.16
6,257,779 B1 * 7/2001 Harris et al. ..... 400/55
6,336,760 B2 * 1/2002 Mori et al. ..... 400/649
6,494,631 B1 * 12/2002 Mastinick ..... 400/208

FOREIGN PATENT DOCUMENTS

JP 5-24307 2/1993
JP 2000-272200 10/2000

* cited by examiner

*Primary Examiner*—Andrew H. Hirshfeld
*Assistant Examiner*—Dave A. Ghatt
(74) *Attorney, Agent, or Firm*—Nixon & Vanderhye P.C.

(57) ABSTRACT

A print head is provided in a casing of a printing apparatus having a housing section which houses continuous paper therein, to perform printing on the continuous paper. A platen roller has a platen shaft rotatably supported on a cover of the printing apparatus which is pivotably supported on the casing to open or close the housing section. The platen roller being abutted against the print head through the continuous paper situated therebetween and rotating to feed the continuous paper, when the cover is closed. A head support member is disposed in the casing and has a head shaft which pivotably supports the print head so as to vary a distance with respect to the platen roller. A lock lever is pivotable about the platen shaft. The lock lever is engaged with the head shaft to determine a position of the platen roller with respect to the print head when the cover is closed.

15 Claims, 14 Drawing Sheets

PRINTER UNIT AND PRINTING APPARATUS INCORPORATING THE SAME

BACKGROUND OF THE INVENTION

The invention relates to a printer unit which effects printing on continuous paper such as rolled paper and a printing apparatus incorporating such a printer unit.

In the related art, one type of printing apparatus includes a housing section for housing continuous paper, such as rolled paper, and effects printing by drawing the continuous paper from the housing section. Printing apparatus of this type has an opening section that is opened and closed by a cover. The continuous paper is replaced and the inside of the printing apparatus is maintained through this opening section. When installing or replacing the continuous paper, the printing apparatus entails a necessity of manually drawing the continuous paper from the housing section and setting the thus-drawn continuous paper along a predetermined paper path. It is therefore preferable to locate a print head on the side of the housing and a platen roller disposed in a position opposite to the print head on the side of the cover for opening and closing the opening section of the housing. This configuration assures that the continuous paper can be easily aligned in the paper path when the cover is opened to replace the continuous paper because the platen roller retracts with the cover and thus opens the paper path.

If a thermal print head is used in a printing apparatus, securing of print quality requires accurate positioning of a platen roller with a print line of a print head and pressing of continuous paper against the print line of the print head (with the platen roller). To this end, such a cover of an ordinary thermal printing apparatus is equipped with a pivotable lock lever. The platen roller is positioned by causing the lock lever to engage with the housing.

However, in the related-art printing apparatus, the lock lever is pivotally supported by a lever shaft projecting from the platen frame. The lock lever is engaged with a locking shaft projecting from a head frame. Hence, there is a potential risk of accuracy of positioning of the platen roller with the print head being deteriorated by an error in machining of the platen frame, an error in attachment of the lever shaft to the platen frame, an error in machining of the head frame, and an error in attachment of the locking shaft to the head frame.

SUMMARY OF THE INVENTION

It is therefore an object of the invention to provide a printer unit, which enables an improvement in the accuracy of positioning of a platen roller with respect to a print head by minimizing error factors existing between the platen roller and the print head, which obviates a necessity for special lever axis (shaft) or locking axis (shaft), and which enables an attempt for reducing the number of parts and simplifying the structure thereof.

It is also an object of the invention to provide a printing apparatus incorporating such a printer unit.

In order to achieve the above objects, according to the present invention, there is provided a printer unit, comprising:

- a print head, provided in a casing of a printing apparatus having a housing section which houses continuous paper therein, and operable to perform printing on the continuous paper;
- a platen roller, having a platen shaft rotatably supported on a cover of the printing apparatus which is pivotably supported on the casing to open or close the housing section, the platen roller being abutted against the print head with the continuous paper therebetween and rotated to feed the continuous paper, when the cover is closed;
- a head support member, disposed in the casing and pivotably supporting the print head around a head shaft so as to move the print head toward the platen roller; and
- a lock lever, which is pivotable about the platen shaft and is engaged with the head shaft to determine a position of the platen roller with respect to the print head when the cover is closed.

Preferably, the head shaft is disposed closer to a pivot of the cover than a printing face of the print head. In such a configuration, since the lock lever is arranged so as not to project from the extremity of the cover, the lock lever is prevented from interfering with opening and closing of the cover, and designing of the cover can be facilitated.

Preferably, an imaginary line passing through an axis of the platen shaft and an axis of the head shaft is substantially parallel with a printing face of the print head when the cover is closed. In such a configuration, positioning of the platen roller with respect to the print head is facilitated, and printing accuracy can be improved by suppressing displacement of the platen roller resulting from driving reaction force.

Preferably, the printer unit further comprises: a platen frame, fixed on the cover, and formed with supporting holes elongated in a direction substantially perpendicular to a printing face of the print head when the cover is closed; and bearing members, through which both ends of the platen shaft is rotatably supported on the platen frame, each of the bearing members being supported by each of the supporting holes movably in an elongating direction of the supporting holes. In such a configuration, since the platen roller (platen shaft) is movable back and forth along with the lock lever, the platen roller can be positioned accurately with respect to the print head without being affected by an error in attachment of the head support member (or a head frame described below) to the casing or the platen frame to the cover.

Here, it is preferable that: the lock lever includes a first engagement member and a first stopper; the platen frame includes a second engagement member and a second stopper; the printer unit further comprises an urging member interposed between the first engagement member and the second engagement member so as to pivot the lock lever in a first direction such that the lock lever engages with the head shaft; and a pivotal movement of the lock lever in the first direction is restricted when the first stopper and the second stopper come in contact with each other.

It is also preferable that the lock lever is formed with a tapered portion which is brought into contact with the head shaft to pivot, for example, temporarily, the lock lever in a second direction opposite to the first direction during a closing operation of the cover.

Further, it is preferable that the head support member is formed with grooves into which the bearing members are respectively fitted when the cover is closed.

Still further, it is preferable that the head support member is formed with projections onto which the bearing members are respectively brought into contact during a closing operation of the cover, so that the print head is temporarily moved away from the platen roller.

Still further, it is preferable that the printer unit as set forth above, further comprises: a head frame, fixed to the casing while pivotably supporting the head support member, the head frame including a first stopper; and an urging member, interposed between the head frame and the head support member so as to pivot the head support member toward the platen roller. The head support member may also further include a second stopper so as to restrict a pivotal movement of the head support member when the first stopper and the second stopper come in contact with each other.

Here, it is preferable that the head frame is formed with grooves into which the bearing members are respectively fitted when the cover is closed.

Further, it is preferable that the head frame includes a guide member which guides the continuous paper into a space between the print head and the platen roller.

Still further, it is preferable that a dimension of each of the bearing members in an axial direction of the platen shaft is greater than an additional thickness of the head frame and the head support member.

Preferably, the lock lever includes a lock releaser which disengages the lock lever from the head shaft.

According to the present invention, there is also provided a printing apparatus incorporating the above described printer unit.

According to the present invention, there is also provided a printing apparatus, comprising:

a print head unit;

a platen unit;

a print head, provided in the print head unit, and operable to perform printing on continuous paper;

a platen roller, provided in the platen unit, having a platen shaft, the platen roller being abutted against the print head with the continuous paper therebetween and rotated to feed the continuous paper;

a head support member, provided in the print head unit, the head support member pivotably supporting the print head around a head shaft so as to move the print head toward the platen roller; and a lock lever, provided in the platen unit, the lock lever being pivotable about the platen shaft and engaged with the head shaft to determine a position of the platen roller with respect to the print head.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE PREFERRED EMBODIMENTS

Figure 1:
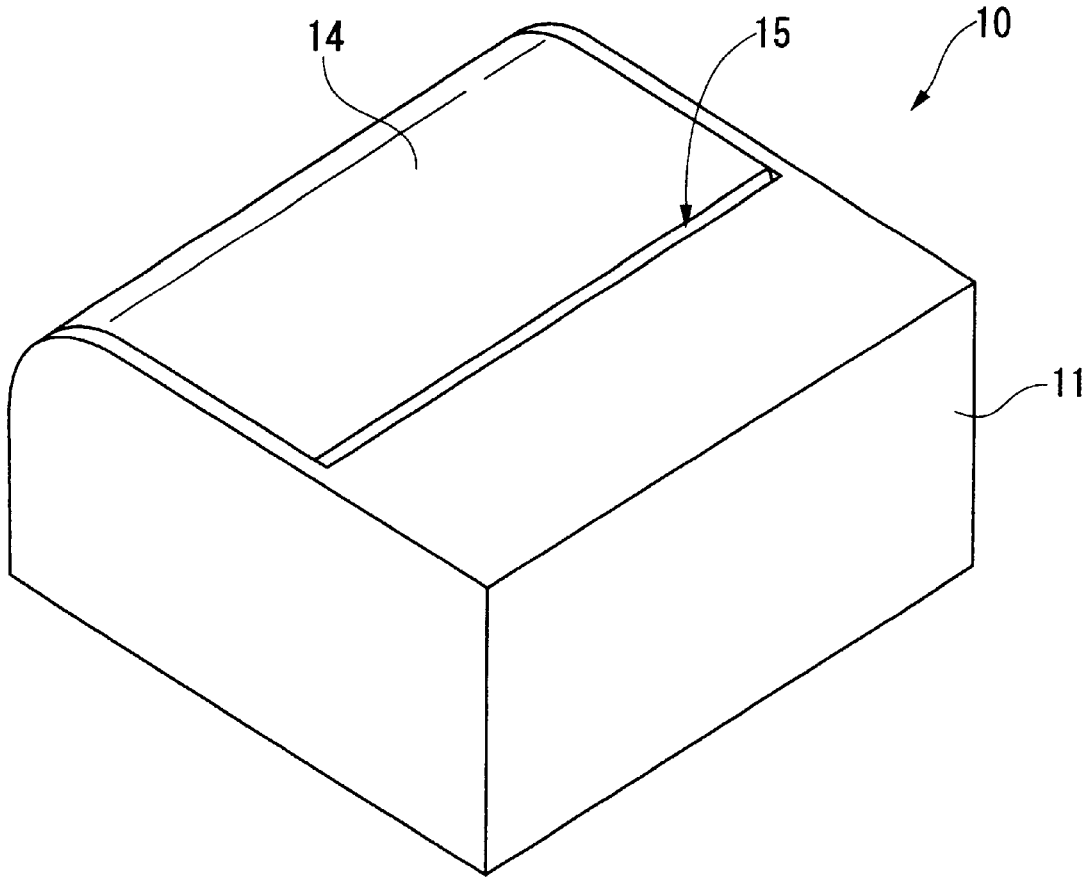
FIG. 1 is a perspective view of a printing apparatus when a cover is closed.
Figure 2:
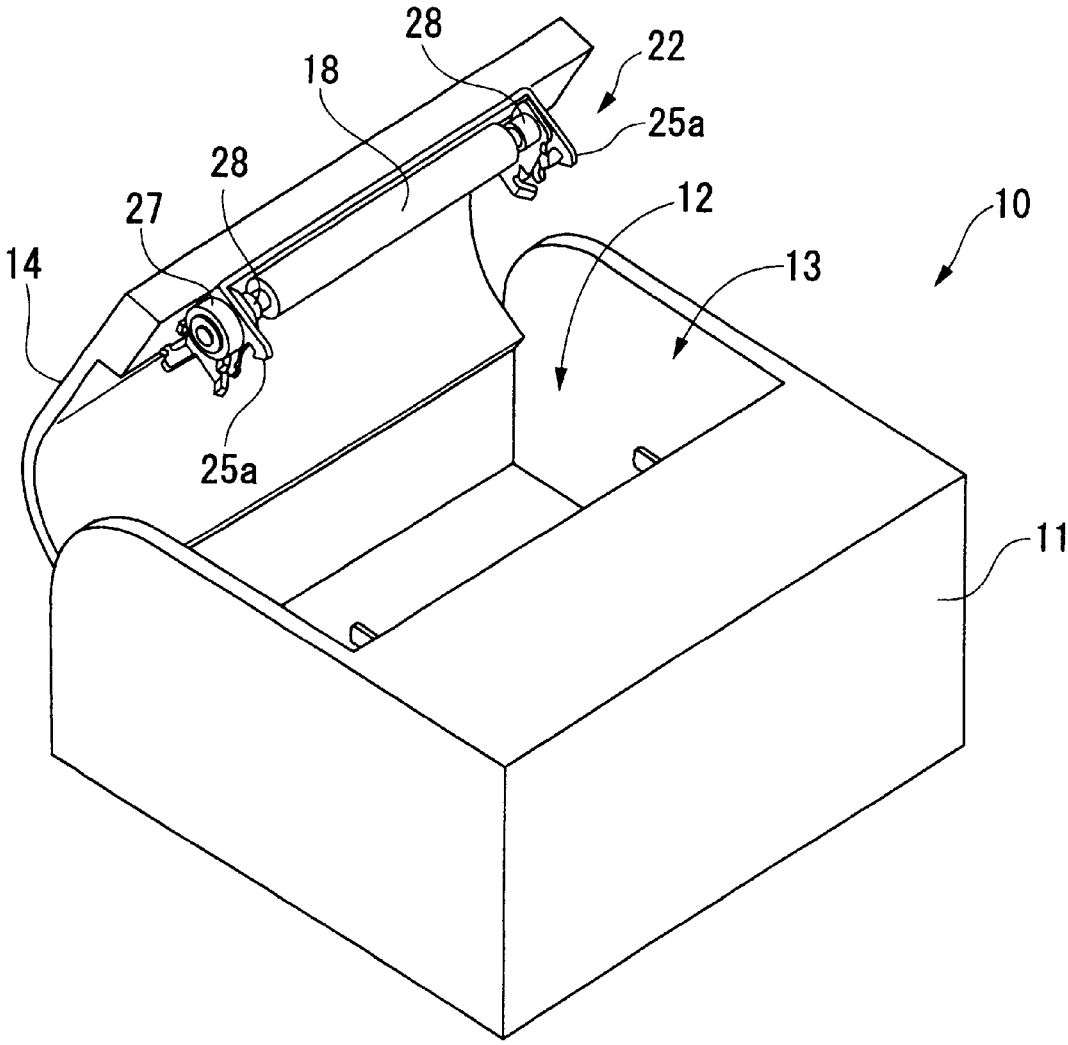
FIG. 2 is a perspective view of the printing apparatus when the cover is opened.
Figure 3:
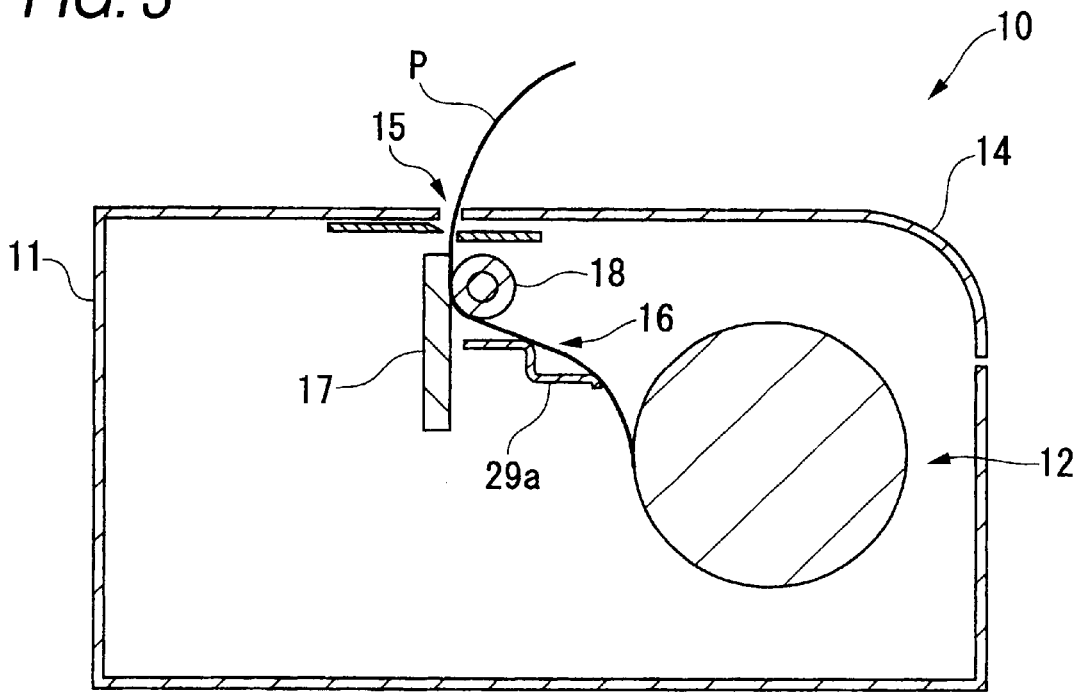
FIG. 3 is a schematic cross-sectional view of the printing apparatus.
Figure 4:
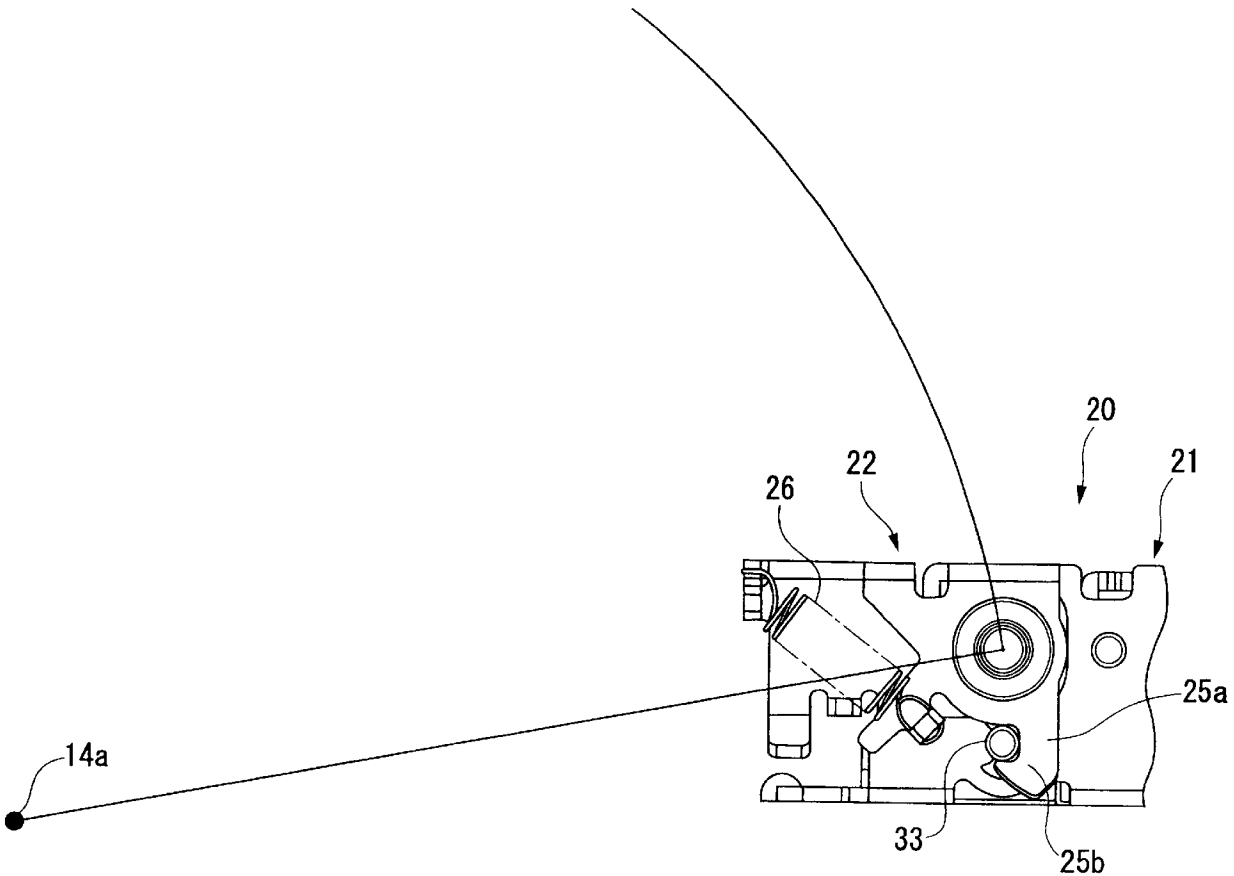
FIG. 4 is a fragmentary side view of a printer unit when the cover is closed.
Figure 5:
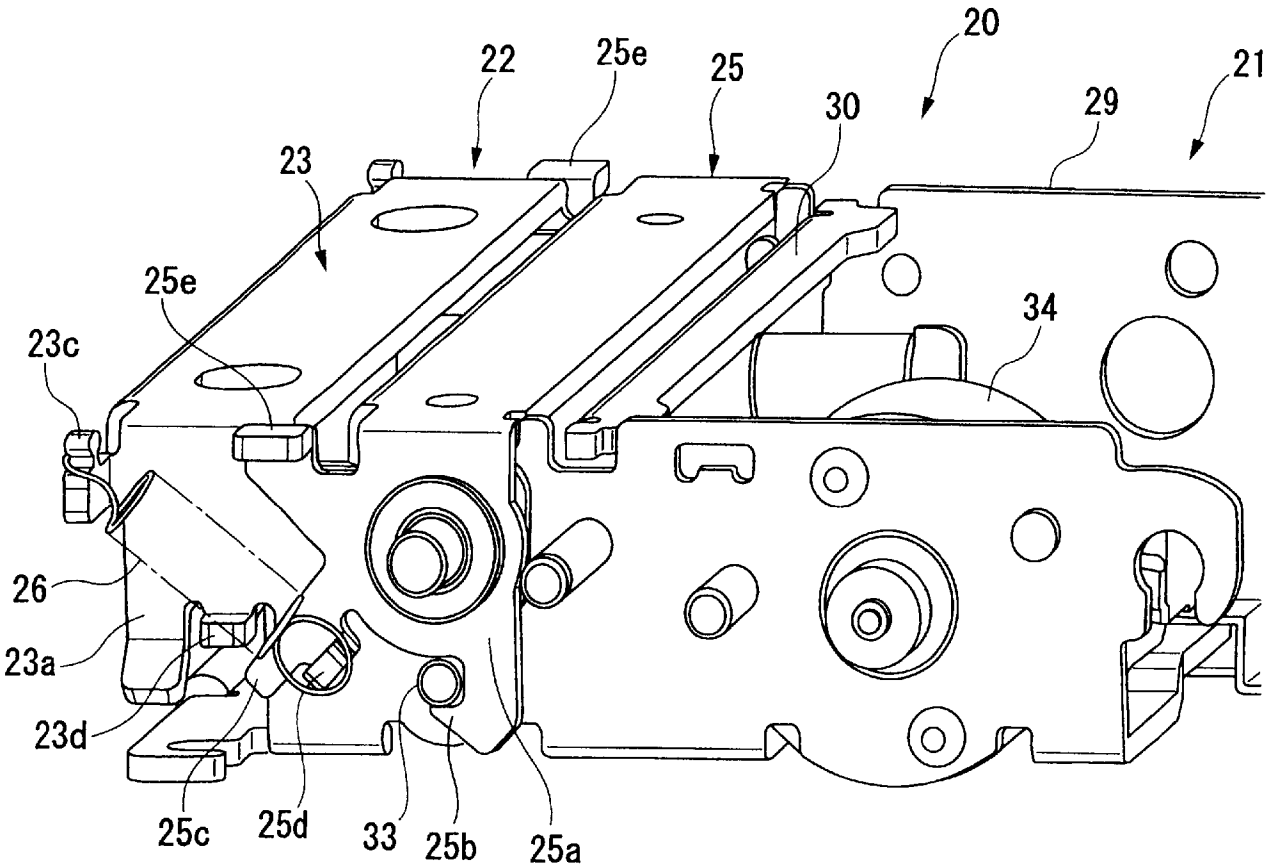
FIG. 5 is a perspective view of the printer unit when the cover is closed.
Figure 6:
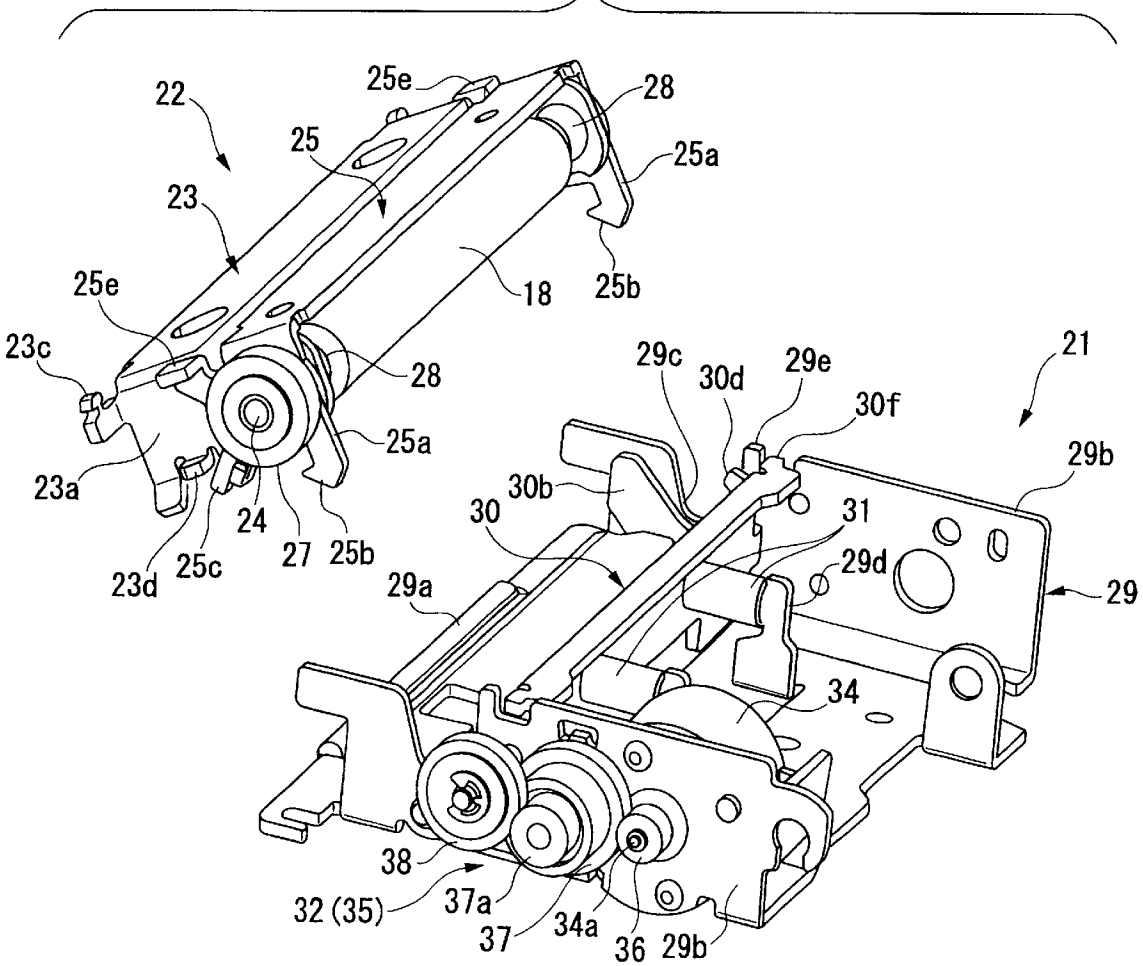
FIG. 6 is a perspective view of the printer unit when the cover is opened.
Figure 7:
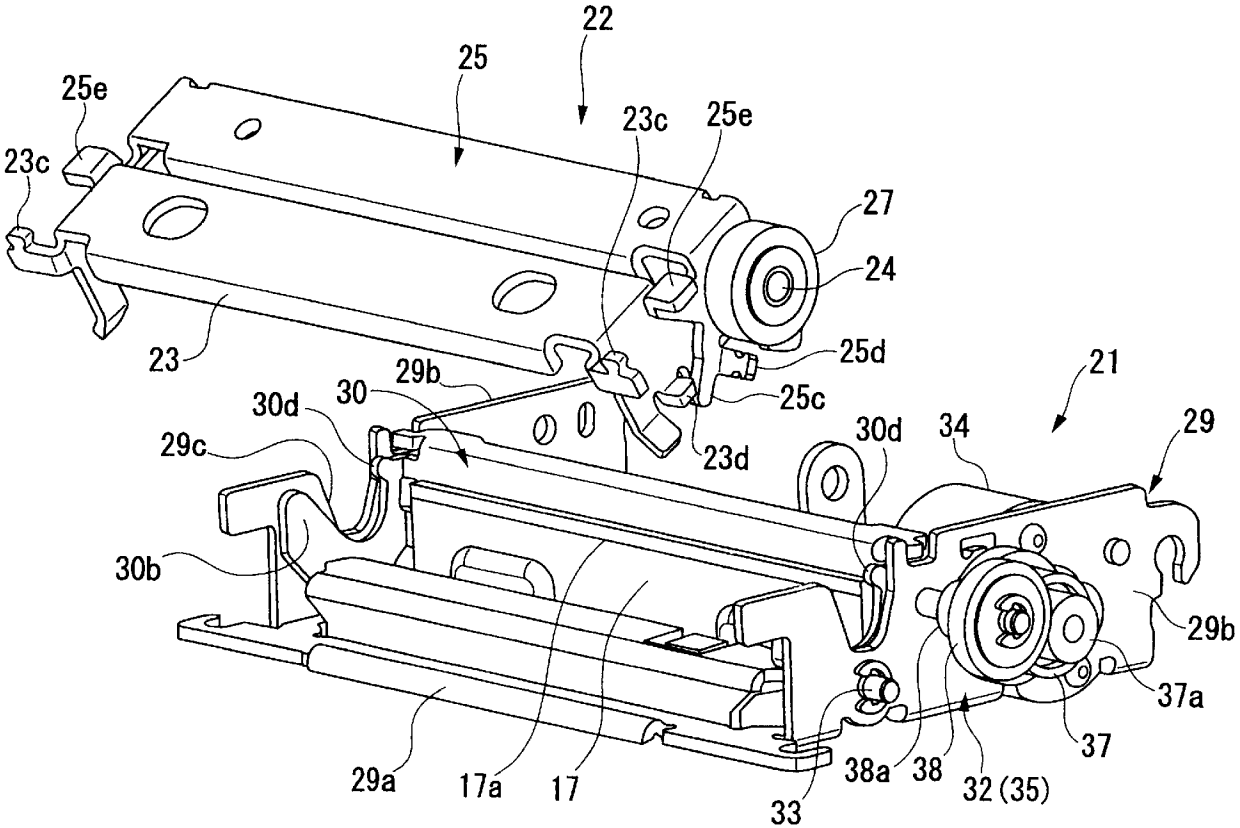
FIG. 7 is a perspective view of the printer unit shown in FIG. 6 when viewed from another angle.

An embodiment of the invention will be described hereinbelow by reference to the accompanying drawings. As will be known from FIGS. 1 to 3, the printing apparatus 10 comprises a housing section 12 for housing rolled paper P as a type of continuous paper is provided in a casing 11. An opening section 13 is formed above the housing section 12, and rolled paper P is replaced through the opening section 13. The opening section 13 is opened and closed by a cover 14 which is pivotable up and down while a rear end of the cover 14 is taken as a pivot. A slit-shaped discharging port 15 is formed between an front end of the cover 14 and a front edge of the opening section 13. One end of the rolled paper P rotatably retained in the housing section 12 is withdrawn from the discharging port 15 by way of a paper path 16.

Disposed along the paper path 16 are a thermal print head 17, a platen roller 18 for transporting the rolled paper P at a position opposite the print head 17, and a cutter unit 19 for cutting the rolled paper P at a position downstream of the platen roller 18. When the printing apparatus 10 has received a print instruction, the print head 17 effects printing on the rolled paper P while the platen roller 18 feeds the rolled paper P. Subsequently, the printed portion of the paper is further advanced toward the discharging port 15. When the trailing end of the printed portion reaches a particular position relative to the cutter unit 19, the cutter unit 19 cuts the paper to separate the printed portion from the paper unwound from the rolled paper P. The separated portion is then supplied from the discharging port 15 as a single cut sheet to a user.

As shown in FIGS. 4 to 7, a printing mechanism of the printing apparatus 10 is assembled into a unit such as a printer unit 20. The printer unit 20 comprises a head unit 21 to be provided on a main body of the printing apparatus (i.e., the casing 11), and a platen unit 22 to be provided on the cover 14. As a result, in a state in which the cover 14 is opened, the platen roller 18 to be built into the platen unit 22 retracts from the print head 17 to be built in the head unit 21, thereby opening a paper path 16. When the rolled paper P is replaced, the cover 14 is opened, and the rolled paper P is housed in the housing section 12. Subsequently, one end of the rolled paper P is drawn to the outside of the casing 11. In this state, the cover 14 is closed, whereby the rolled paper P is set along the paper path 16.

Figure 8:
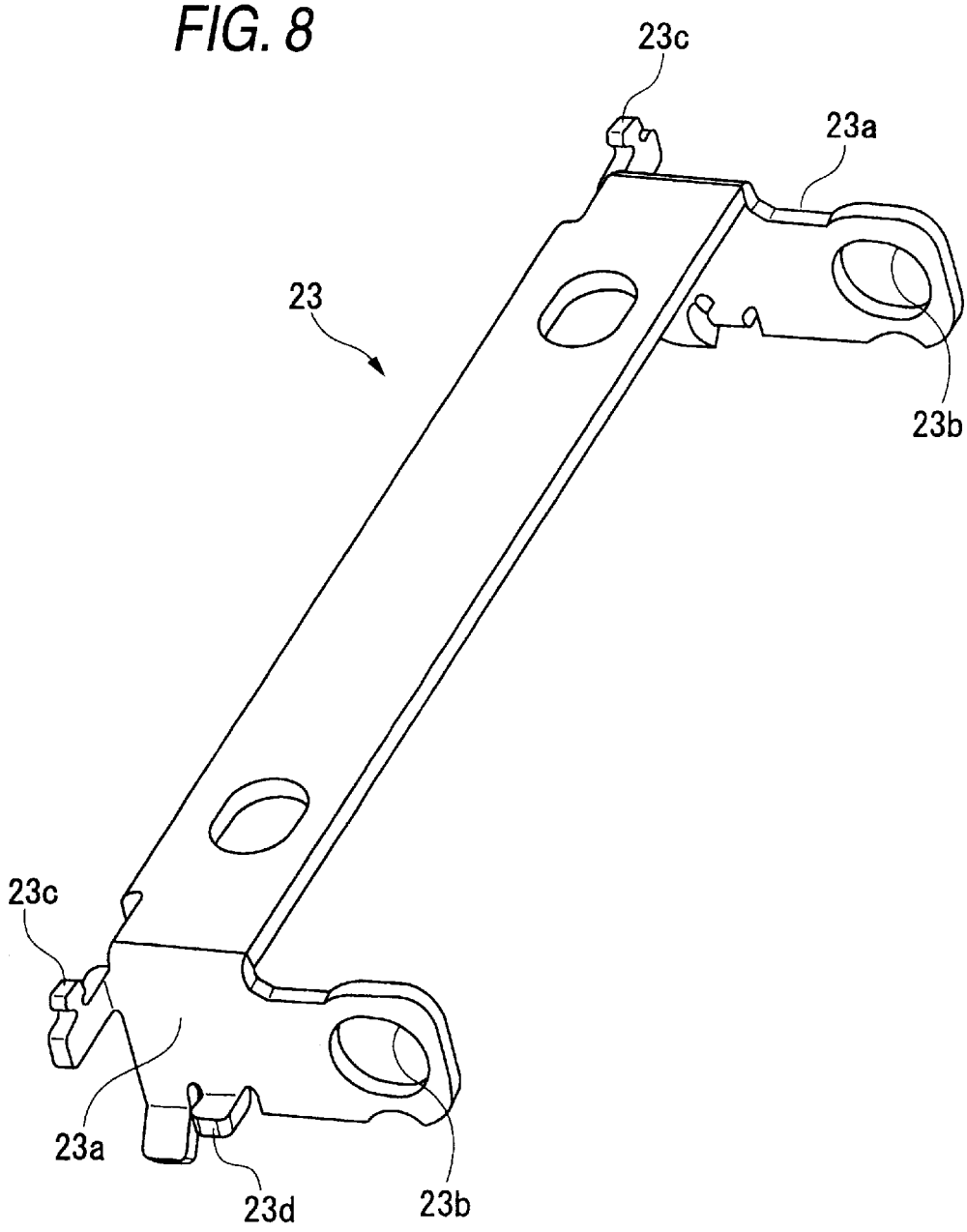
FIG. 8 is a perspective view of a platen frame.

The platen unit 22 comprises a platen frame 23 to be fixed on a lower face of the front end of the cover 14; a platen shaft 24 rotatably supported by the platen frame 23; a lock member 25 which pivots back and forth around the platen shaft 24; and springs 26 for urging the lock member 25 backward. As shown in FIG. 8, the platen frame 23 is formed so as to assume the shape of a gate when viewed from the front. Elongated platen support holes 23*b* are formed in respective side plates 23*a*. The platen roller 18 is provided integrally in an intermediate portion of the platen shaft 24. A platen gear 27 is provided integrally on the left end of the platen shaft 24. Both ends of the platen shaft 24 penetrate through corresponding platen support holes 23*b* and are supported by the platen frame 23 via bearing members 28.

An inner side edge of each bearing member 28 extends toward the platen roller 18 so as to have a width wider than an additional thickness of a head frame 29 and a head support member 30 (described later) in an axial direction of the platen shaft 24.

Figure 9:
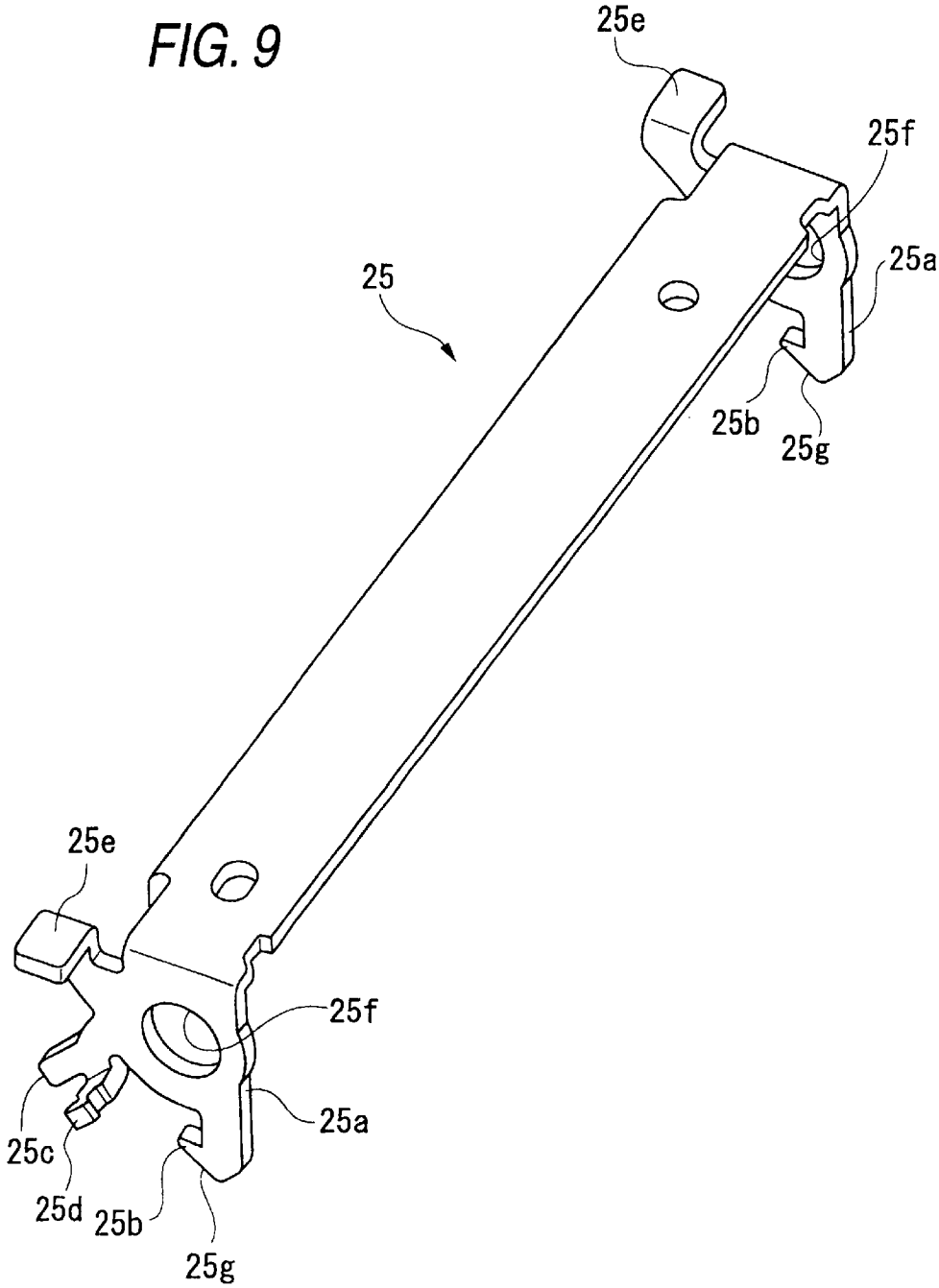
FIG. 9 is a perspective view of a lock member.

As shown in FIG. 9, the lock member 25 is formed so as to assume the shape of a gate when viewed from the front. A lock lever 25*a* is provided on either side of the lock member 25. Integrally formed in the lock lever 25*a* are an engagement hook 25*b*, a stopper piece 25*c*, a spring engagement piece 25*d*, a lock release piece 25*e*, and a support hole 25*f*. The support hole 25*f* is pivotably fitted around a corresponding bearing member 28. The lock member 25 is supported so as to be pivotable back and forth around the platen shaft 24.

Each of the springs 26 is interposed in a pulled state between a spring engagement piece 23*c* formed at the rear end of the platen frame 23 and the spring engagement piece 25*d* of the lock lever 25*a*. Further backward pivotal movement of the lock levers 25*a*, which are urged backward by the springs 26, is restricted as a result of the stopper pieces 25*c* coming into contact with stopper pieces 23*d* of the platen frame 23. At this time, the lock levers 25*a* are oriented in a direction substantially perpendicular to the cover 14, thereby avoiding projection of the lock levers 25*a* from the extremity of the cover 14. In place of the stopper pieces 23*d* of the platen frame 23, projections projecting outside from side plates 23*a* may be formed.

The head unit 21 comprises a head frame 29 to be mounted on the main body of the printing apparatus; a head support member 30 to be provided on the head frame 29 so as to be pivotable back and forth; springs 31 for urging the head support member 30 to the platen roller 18; and a platen drive mechanism 32 for transmitting driving force to the platen roller 18. The head frame 29 is formed so as to assume the shape of the letter U when viewed from the front. A step-shaped paper guide 29*a* (see FIG. 3) is formed at the rear end of the head frame 29 for guiding the rolled paper P drawn from the housing section 12 into a space defined between the print head 17 and the platen roller 18. A fitting groove 29*c* is formed in each of side plate sections 29*b* of the head frame 29. When the cover 14 is closed, the bearing members 28 are fitted into the fitting grooves 29*c* from above.

Figure 10:
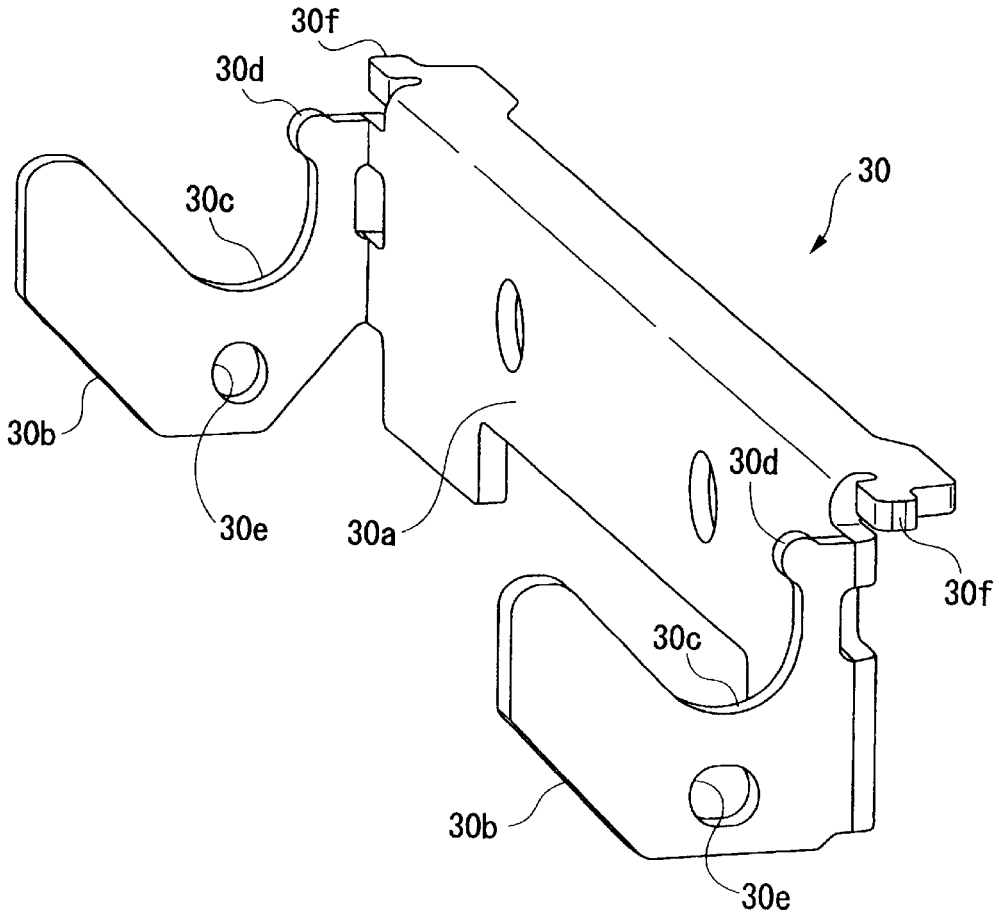
FIG. 10 is a perspective view of a head support member.
Figure 11:
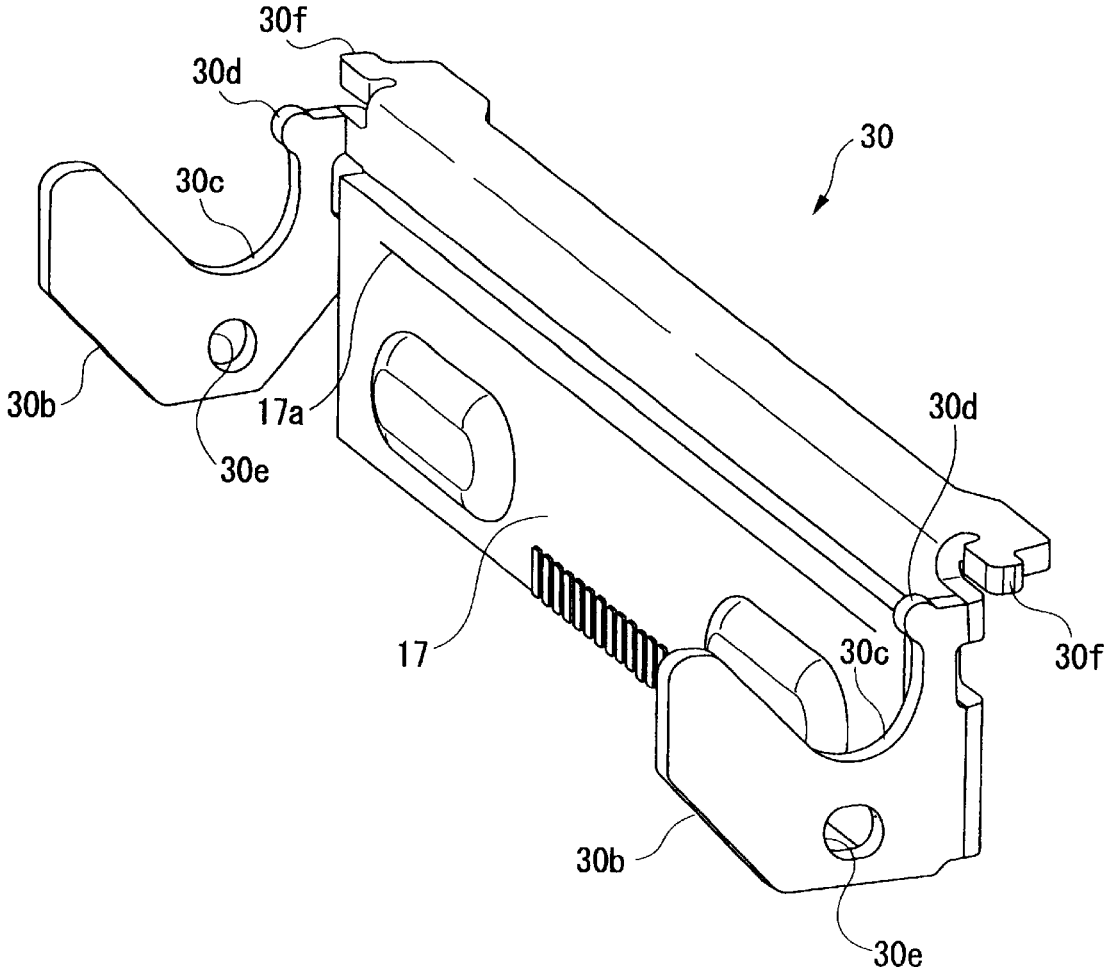
FIG. 11 is a perspective view of the head support member provided with a print head.

As shown in FIGS. 10 and 11, the head support member 30 is formed so as to assume the shape of the letter U when viewed from the top. The print head 17 is bonded integrally to a supporting face 30*a* opposing the platen roller 18. The thermal print head 17 has the shape of a flat plate of specified thickness. A print line (heating element) 17*a* is formed at an upper front end so as to extend from side to side. In order to ensure print quality, the print head 17 of this type is required to press the rolled paper P against the print line 17*a*. In order to satisfy this requirement, the head support member 30 is disposed to rotate freely back and forth on the head frame 29 by way of the rotary shaft 33, and is urged to the platen roller 18 side by the springs 31.

An arm section 30*b* is provided on either side of the head support member 30 so as to extend backward. A fitting groove 30*c* is formed in each of the arm sections 30*b* such that the respective bearing members 28 fit into the grooves 30*c* from above when the cover 14 is closed. Further, a contact projection 30*d* is formed integrally on each arm section 30*b* so as to come into contact with a corresponding bearing member 28 and to cause the head support member 30 (print head 17) to temporarily retract from the platen roller 18. A support hole 30*e* is formed proximally below the fitting groove 30*c* on each of the arm sections 30*b*. The rotary shaft 33 penetrating through the support holes 30*e* is offset backward with reference to a printing face of the print head 17 (i.e., close to a pivot 14*a* of the cover 14). Both ends of the rotary shaft 33 also serve as locking shafts which engage the engagement hooks 25*b* of the lock levers 25*a*.

The springs 31 are interposed in a compressed state between the pair of spring support pieces 29*d* standing on the head frame 29 and the head support member 30 to be urged backward. As a result of stopper pieces 30*f* projecting from both ends of the head support member 30 coming into contact with the stopper pieces 29*e* of the head frame 29, further backward pivotal movement of the head support member 30 is restricted.

Since the rotary shaft 33 is offset closer to the pivot 14*a* of the cover 14 than to the printing face of the print head 17, the lock levers 25*a* can be arranged so as not to project from the extremity of the cover 14. Consequently, elimination of an inconvenience, such as interference in opening and closing action of the cover 14 by the lock lever 25*a* can be achieved, along with facilitation of designing of the casing 11.

Further, the necessity for special lever shaft or locking shaft is obviated, thereby enabling reduction of the number of components and simplifying the structure of a printing apparatus.

A platen drive mechanism 32 comprises a motor 34 disposed at a left inner part on the head frame 29; and a gear train 35 which transmits driving force of the motor 34 to the platen gear 27. The gear train 35 comprises a drive gear 36 provided on a motor shaft 34*a* of the motor 34; a first transmission gear 37 meshing with the drive gear 36; a second transmission gear 37*a* formed integrally with the first transmission gear 37; a third transmission gear 38 meshing with the second transmission gear 37*a*; and a fourth transmission gear 38*a* formed integrally with the third transmission gear 38. The gear train 35 is disposed along the left outside surface of the head frame 29. When the cover 14 is closed, the platen gear 27 engages the fourth transmission gear 38*a*. When the motor 34 is rotated in a predetermined direction in this state, the platen roller 18 performs a paper feeding operation.

Figure 12C:
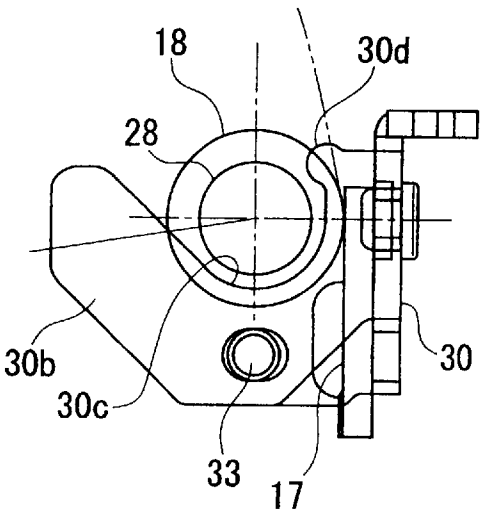
FIGS. 12A to 12C are descriptive views showing temporary retracting action of the print head.

Next, the temporary retracting action of the print head 17 to be performed at the time of closing of the cover 14 will be described by reference to FIGS. 12A to 12C. As shown in FIG. 12A, when the cover 14 is opened, the platen roller 18 retracts with the cover 14 from the print head 17, thereby opening the paper path 16. At this time, the head support member 30 is rotated backward by pressing action of the springs 31. In association with backward rotation, the print head 17 enters the path of movement of the platen roller 18.

Figure 12B:
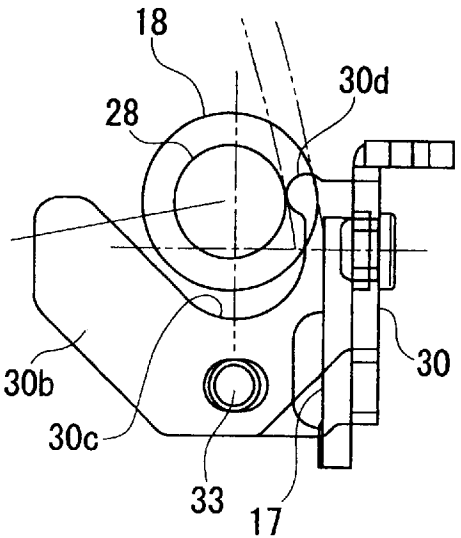
Figure 12A:
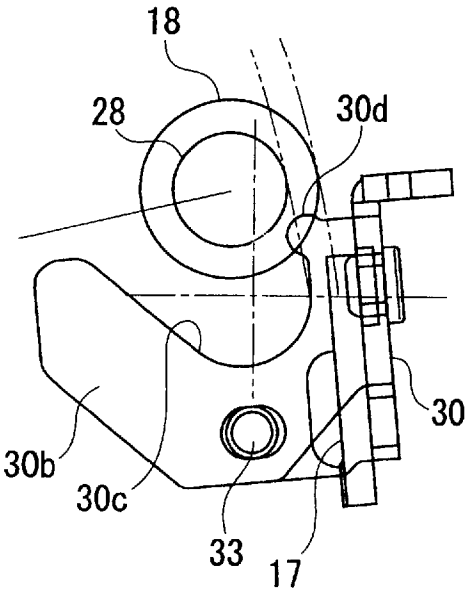

As shown in FIG. 12B, when the cover 14 is closed, the bearing members 28 for supporting both sides of the platen shaft 24 come into contact with the contact projections 30*d* of the head support member 30 at a position before a closing position. In response to the contact, the head support member 30 temporarily retracts and rotates forward. In association with such a temporary retracting rotation, an upper edge of the print head 17 retracts from the locus of movement of the platen roller 18. As a result, the cover 14 can be closed without causing the platen roller 18 to come into contact with the upper edge of the print head 17.

As shown in FIG. 12C, when the cover 14 reaches a predetermined closing position, the head support member 30 that has temporarily retracted and moved forward is rotated backward under the force of the springs 31 in association with the contact projections 30*d* departing from the bearing members 28. As a result, the print line 17*a* of the print head 17 is pressed against the platen roller 18 via the rolled paper P, thus entering a printable state.

Figure 13:
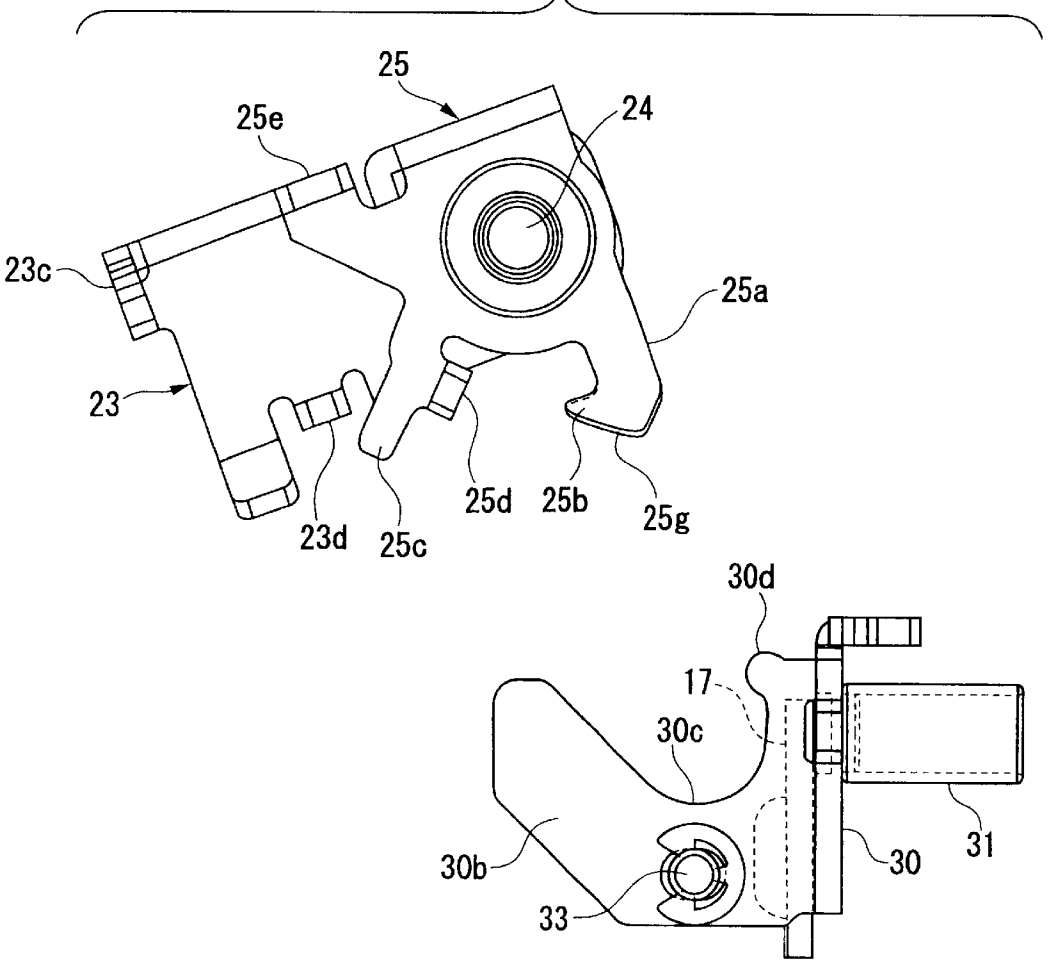
FIG. 13 is a descriptive view showing positioning action of a platen roller when the cover is opened.

Next, the positioning operation of the platen roller 18 (cover locking operation) will be described by reference to FIGS. 13 and 14. As shown in FIG. 13, the lock levers 25*a* are disposed freely rotatable back and forth about the platen shaft 24. When the cover 14 is opened, the lock levers 25*a* are rotated backward under the force of the springs 26. At this time, the lock levers 25*a* are oriented in a direction substantially perpendicular to the cover 14, thus avoiding projection from the extremity of the cover 14. When an operation for closing the cover 14 is performed, tapered sections 25*g* formed at the extremities of the respective engagement hooks 25*b* come into contact with respective ends of the rotary shaft 33 at a position before the closing position. In association with the contacting action, the lock levers 25*a* are rotated forward.

Figure 14:
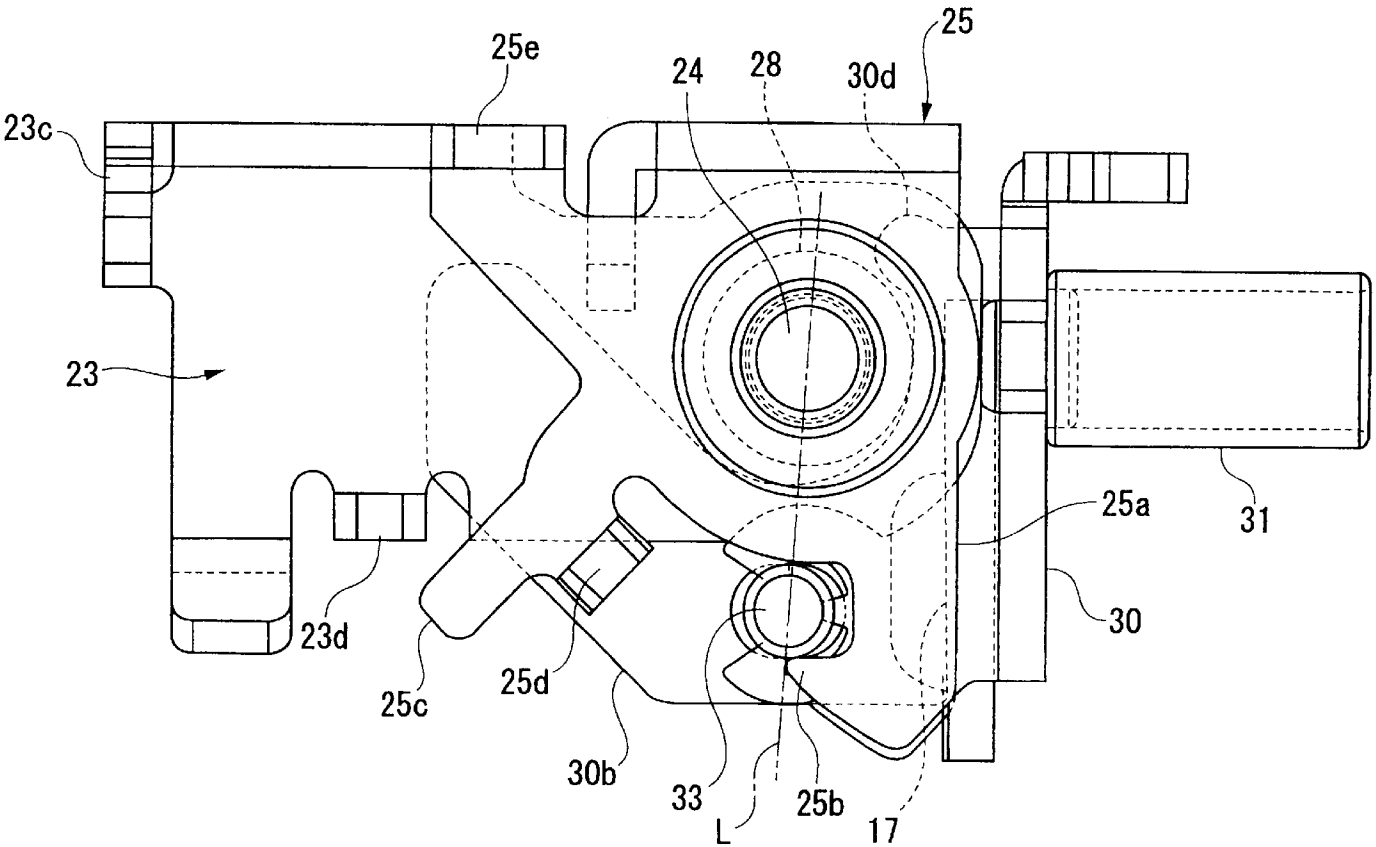
FIG. 14 is a descriptive view showing positioning action of the platen roller when the cover is closed.

As shown in FIG. 14, when the cover 14 reaches the closing position, the lock levers 25*a* are rotated backward under the force of the springs 26, whereby the engagement hooks 25*b* engage the respective ends of the rotary shaft 33. As a result, the platen roller 18 is positioned relative to the print line 17*a* of the print head 17, and the opening and closing actions of the cover 14 are locked. The accuracy of positioning of the platen roller 18 relative to the print line 17*a* of the print head 17 is determined by members interposed between the print head 17 and the platen roller 18; that is, the head support member 30, the rotary shaft 33, the lock lever 25*a* (lock member 25), the bearing members 28, and the platen shaft 24, therefore, the platen roller 18 can be positioned with high accuracy with respect to the print line 17*a* without affecting the accuracy of the head frame 29 or that of the platen frame 23. Since the platen support holes 23*b* are elongated in the front and rear directions, the platen roller 18 (platen shaft 24) can move back and forth along with the lock levers 25*a* (lock member 25). As a result, the platen roller 18 can be positioned accurately with respect to the print line 17*a* without being affected by an error in attachment of the platen frame 23 to the cover 14 or an error in attachment of the head frame 29 to the casing 11.

Namely, the accuracy of positioning of the platen roller 18 and the print head 17 can be improved by minimizing error factors existing between the platen roller 18 and the print head 17.

As shown in FIG. 14, a imaginary line L passing through the platen shaft 24 and the rotary shaft 33 is substantially parallel to the printing face of the print head 17. In short, the rotary shaft 33 is placed proximally right below the platen shaft 24. Hence, positioning of the platen roller 18 with respect to the print head 17 in a longitudinal (vertical) direction is facilitated. Further, the drive reaction force acting on the platen roller 18 is received at a position located proximally right below the platen roller 18. There is inhibited displacement of the platen roller 18, which would otherwise be caused by the drive reaction force, thereby improving printing accuracy.

The lock lever 25*a* is unlocked in accordance with actuation of unlock buttons (not shown) engaging the lock release pieces 25*e* of the lock levers 25*a*.

An embodiment of the invention has been described by reference to the accompanying drawings. However, the invention is not limited to items described in the embodiment. Persons skilled in the art can freely modify or apply the invention on the basis of claims, the description of the invention, and the known technology. For instance, the invention can be applied to a printing apparatus in which a print head (head unit) is provided on a cover and in which a platen roller (platen unit) is provided on a main body.

What is claimed is:

1. A printer unit, comprising:

a print head, provided in a casing of a printing apparatus having a housing section which houses continuous paper therein, and operable to perform printing on the continuous paper;

a platen roller, having a platen shaft rotatably supported on a cover of the printing apparatus which is pivotably supported on the casing to open or close the housing section, the platen roller being abutted against the print head with the continuous paper therebetween and rotated to feed the continuous paper, when the cover is closed;

a head support member, disposed in the casing and pivotably supporting the print head around a head shaft so as to move the print head toward the platen roller; and a lock lever, which is pivotable about the platen shaft, and is engaged with the head shaft to determine a position of the platen roller with respect to the print head when the cover is closed.

2. The printer unit as set forth in claim 1, wherein the head shaft is disposed closer to a pivot of the cover than a printing face of the print head.

3. The printer unit as set forth in claim 1, wherein an imaginary line passing through an axis of the platen shaft and an axis of the head shaft is substantially parallel with a printing face of the print head when the cover is closed.

4. The printer unit as set forth in claim 1, further comprising:

a platen frame, fixed on the cover, and formed with supporting holes elongated in a direction substantially perpendicular to a printing face of the print head when the cover is closed; and bearing members, through which both ends of the platen shaft are rotatably supported on the platen frame, each of the bearing members being movably supported by each of the supporting holes in an elongating direction of the supporting holes.

5. The printer unit as set forth in claim 4, wherein:

the lock lever includes a first engagement member and a first stopper;

the platen frame includes a second engagement member and a second stopper;

the printer unit further comprises an urging member interposed between the first engagement member and the second engagement member so as to pivot the lock lever in a first direction such that the lock lever engages with the head shaft; and a pivotal movement of the lock lever in the first direction is restricted when the first stopper and the second stopper come in contact with each other.

6. The printer unit as set forth in claim 5, wherein the lock lever is formed with a tapered portion which is brought into contact with the head shaft to pivot the lock lever in a second direction opposite to the first direction during a closing operation of the cover.

7. The printer unit as set forth in claim 4, wherein the head support member is formed with grooves into which the bearing members are respectively fitted when the cover is closed.

8. The printer unit as set forth in claim 4, wherein the head support member is formed with projections onto which the bearing members are respectively brought into contact during a closing operation of the cover, so that the print head is temporarily moved away from the platen roller.

9. The printer unit as set forth in claim 4, further comprising:

a head frame, fixed to the casing while pivotably supporting the head support member, the head frame including a first stopper; and an urging member, interposed between the head frame and the head support member so as to pivot the head support member toward the platen roller, wherein the head support member includes a second stopper so as to restrict a pivotal movement of the head support member when the first stopper and the second stopper come in contact with each other, and wherein the head frame is formed with grooves into which the bearing members are respectively fitted when the cover is closed.

10. The printer unit as set forth in claim 1, further comprising:

a head frame, fixed to the casing while pivotably supporting the head support member, the head frame including a first stopper; and an urging member, interposed between the head frame and the head support member so as to pivot the head support member toward the platen roller, wherein the head support member includes a second stopper so as to restrict a pivotal movement of the head support member when the first stopper and the second stopper come in contact with each other.

11. The printer unit as set forth in claim 10, wherein the head frame includes a guide member which guides the continuous paper into a space between the print head and the platen roller.

12. The printer unit as set forth in claim 10, having bearing members wherein a dimension of each of the bearing members in an axial direction of the platen shaft is greater than an additional thickness of the head frame and the head support member.

13. The printer unit as set forth in claim 1, wherein the lock lever includes a lock releaser which disengages the lock lever from the head shaft.

14. A printing apparatus comprising:

the printer unit as set forth in claim 1;

a casing having a housing section which houses continuous paper therein, the casing also incorporating at least a portion of the printer unit therein; and a cover associated with the casing for providing access to the continuous paper and the printer unit.

15. A printing apparatus, comprising:

a print head unit, a platen unit;

a print head, provided in the print head unit, and operable to perform printing on continuous paper;

a platen roller, provided in the platen unit, having a platen shaft, the platen roller being abutted against the print head with the continuous paper therebetween and rotated to feed the continuous paper;

a head support member, provided in the print head unit, the head support member pivotably supporting the print head around a head shaft so as to move the print head toward the platen roller; and a lock lever, provided in the platen unit, the lock lever being pivotable about the platen shaft, and engaged with the head shaft to determine a position of the platen roller with respect to the print head.

* * * * *